US011039253B2

(12) United States Patent
Zhang

(10) Patent No.: US 11,039,253 B2
(45) Date of Patent: Jun. 15, 2021

(54) IMAGE RECOGNITION-BASED ELECTRONIC LOUDSPEAKER

(71) Applicant: YUYAO FEITE PLASTIC CO., LTD., Yuyao (CN)

(72) Inventor: Shanqin Zhang, Yuyao (CN)

(73) Assignee: YUYAO FEITE PLASTIC CO., LTD., Yuyao (CN)

( * ) Notice: Subject to any disclaimer, the term of this patent is extended or adjusted under 35 U.S.C. 154(b) by 67 days.

(21) Appl. No.: 16/469,276

(22) PCT Filed: Jun. 30, 2017

(86) PCT No.: PCT/CN2017/091157
§ 371 (c)(1),
(2) Date: Jun. 13, 2019

(87) PCT Pub. No.: WO2018/223464
PCT Pub. Date: Dec. 13, 2018

(65) Prior Publication Data

US 2020/0107133 A1 Apr. 2, 2020

(30) Foreign Application Priority Data

Jun. 6, 2017 (CN) ..... 201710419033.3

(51) Int. Cl.
*H04R 9/02* (2006.01)
*H04R 9/06* (2006.01)

(52) U.S. Cl.
CPC ..... *H04R 9/025* (2013.01); *H04R 9/06* (2013.01)

(58) Field of Classification Search
CPC ..... H04R 9/025; H04R 9/06
See application file for complete search history.

(56) References Cited

U.S. PATENT DOCUMENTS 9,499,095 B1 * 11/2016 Buehler ..... B60Q 1/2611
2002/0084891 A1 * 7/2002 Mankins ..... B60Q 1/2611 340/425.5

(Continued)

FOREIGN PATENT DOCUMENTS

CN 201878323 U 6/2011
CN 102342131 A 2/2012

(Continued)

OTHER PUBLICATIONS

International Search Report issued in International Application No. PCT/CN2017/091157, dated Feb. 24, 2018.

(Continued)

*Primary Examiner* — Sunita Joshi
(74) *Attorney, Agent, or Firm* — Charles C Achkar; Ostrolenk Faber LLP.

(57) ABSTRACT

An image recognition-based electric speaker includes a U-shaped iron for increasing magnetic field and improving anti-magnetism, a magnet installed on the U-shaped iron for generating magnetic field, a washer installed on the magnet for increasing the magnetic field and magnetic permeability, a voice coil installed on the washer for electrically conducting power, a voice coil paper tube installed on the voice coil, a damper installed around the voice coil for maintaining the magnetic gap and improving the capability of withstanding power, a box holder mounted around the low-frequency suspension edge, a gasket installed at the lower edge of the box holder for sealing the box holder airtightly, a low-frequency suspension edge disposed around the mid-frequency vibrating plate, a high-frequency anti-dust cap installed on the voice coil paper tube, and a mid-frequency vibrating plate disposed around the anti-dust cap. This invention has the effect of reducing criminal activities.

4 Claims, 1 Drawing Sheet

(56) References Cited

U.S. PATENT DOCUMENTS

| | | | | |
|---|---|---|---|---|
| 2003/0109988 | A1* | 6/2003 | Geissler | G01C 21/12 701/469 |
| 2006/0109988 | A1* | 5/2006 | Metcalf | H04S 3/002 381/104 |
| 2011/0316996 | A1 | 12/2011 | Abe et al. | |
| 2016/0269829 | A1 | 9/2016 | Kang et al. | |
| 2016/0269848 | A1* | 9/2016 | Mitsufuji | H04S 7/30 |
| 2019/0230259 | A1* | 7/2019 | Germe | F16M 11/041 |

FOREIGN PATENT DOCUMENTS

| | | | | |
|---|---|---|---|---|
| CN | 105564297 | A | * | 5/2016 |
| CN | 105564297 | A | | 5/2016 |
| CN | 106507257 | A | | 3/2017 |

OTHER PUBLICATIONS

Written Opinion of the International Searching Authority issued in International Application No. PCT/CN2017/091157, dated Feb. 24, 2018.

* cited by examiner

IMAGE RECOGNITION-BASED ELECTRONIC LOUDSPEAKER

CROSS REFERENCE TO RELATED APPLICATIONS

The present application is a § 371 National Phase application based on PCT/CN2017/091157 filed Jun. 30, 2017, which claims the benefit of China application No. 201710419033.3 filed Jun. 6, 2017, the subject matter of each of which is incorporated by reference in their entirety.

FIELD OF THE INVENTION

The present invention relates to the field of speakers, and more particularly to an image recognition-based electric speaker.

BACKGROUND OF THE INVENTION

Loudspeaker, also known as speaker is a type of transducer that converts electrical signal into sound signal, and the performance of the speaker has a great impact on sound quality. Speaker is one of the weakest devices in audio equipment, and is one of the most important parts for acoustic effect. There are various types of speakers and their prices vary greatly. Audio power vibrates a paper cone or diaphragm to resonate with the surrounding air through electromagnetic, piezoelectric or electrostatic effects to make a sound.

Low-end plastic speakers cannot overcome the resonance and has no sound quality at all because of its thin box body. Of course, there are some good plastic speakers having a better sound quality than that of poor wooden speakers. In general, a wooden speaker reduces the noise caused by the resonance of the box body, and the sound quality of the wooden speaker is usually better than that of the plastic speaker.

A multimedia speaker generally comes with a dual-unit two-way design, wherein a smaller speaker is provided for the output of middle and high notes, and another larger speaker is provided for the output of middle and low notes.

The materials of these two speakers should be taken into consideration for selecting a speaker, and a multimedia active speaker has a treble unit which is mainly a soft spherical dome (or a titanium film dome for simulated sound sources) working with a digital sound source to reduce the stiff feeling of high frequency signals and give us a gentle, smooth, and delicate feeling. The multimedia speaker mainly uses domes such as a good-quality silk diaphragm, a lower-cost PV diaphragm, etc.

The woofer unit determining the sound feature of a speaker is a relatively important unit for users' selection, and the common ones include a paper cone, a plastic-coated paper cone, a paper-based wool cone, a tight pressing cone, etc.

Speakers are usually used in police activities. For example, a police speaker is installed on a police car to give a deterrent effect on potential offenders of dangerous conducts. However, conventional police speakers have a fixed output power, and thus the output power cannot be self-adjusted or changed according to nearby conditions.

SUMMARY OF THE INVENTION

Therefore, it is a primary objective of the present invention to overcome the aforementioned drawbacks of the prior art by providing an image recognition-based electric speaker capable of collecting an image near a police car, and the image is compared with various benchmark dangerous conduct appearances or profiles one by one. If there is a match, then a dangerous conduct signal will be outputted. If there is no match at all, then a non-dangerous conduct signal will be outputted. If the dangerous conduct signal is received, then the power conversion device will send out a power increasing signal; and if the non-dangerous conduct signal will send out a power decreasing signal, so as to ensure the deterrent effect of the speaker for different situations.

To achieve the aforementioned and other objectives, the present invention provides an image recognition-based electric speaker comprising a U-shaped iron, a magnet, a washer, a voice coil, a voice coil paper tube, a damper, a box holder, a gasket, a low-frequency suspension edge, a high-frequency anti-dust cap, and a mid-frequency vibrating plate; the U-shaped iron increases the intensity of magnetic fields and improves the external antimagnetic effect, and the magnet is disposed on the U-shaped iron for generating a magnetic field, and the washer is disposed on the magnet for increasing the emphasis of the magnetic field and the magnetic permeability, and the voice coil is disposed on the washer for electrically conducting electric power, and the damper is disposed around the voice coil for maintaining the magnetic gap and improving the capability of withstanding power; the voice coil paper tube is disposed on the voice coil, and the anti-dust cap is disposed on the voice coil paper tube, and the mid-frequency vibrating plate is disposed around the anti-dust cap, and the low-frequency suspension edge is disposed around the mid-frequency vibrating plate, and the box holder is disposed around the low-frequency suspension edge, and the gasket is disposed at the lower edge of the box holder for sealing the box holder airtightly.

Specifically, the image recognition-based electric speaker further comprises: a voltage conversion device, coupled to a vehicle power supply, for converting an output voltage of the vehicle power supply to obtain different supply voltages required by the electric speaker.

Specifically, the image recognition-based electric speaker further comprises a brightness sensor installed at a police car rooftop and adjacent to a spherical photography device for detecting the ambient brightness of the neighborhood of the spherical photography device.

Specifically, the image recognition-based electric speaker further comprises an auxiliary lighting source installed at a police car roof and adjacent to the spherical photography device and coupled to the brightness sensor for receiving the ambient brightness and providing an auxiliary illuminating light according to the ambient brightness collected from an image data collection by the spherical photography device.

Specifically, the image recognition-based electric speaker further comprises:

a megaphone, coupled to an embedded processing device in a front-end dashboard of a police car through a cable, for receiving a person's voice in the police car, and amplifying the person's voice through the U-shaped iron, the magnet, the washer, the voice coil, the voice coil paper tube, the damper, the box holder, the gasket, the low-frequency suspension edge, the high-frequency anti-dust cap and the mid-frequency vibrating plate;

a spherical photography device, disposed on the box holder, for photographing a street view of where the police car is situated, in order to obtain and output a corresponding high-definition image; the signal analysis device is coupled to the spherical photography device, for receiving high-definition image, and confirming and using the mean square error of the pixel value of the high-definition image as a target mean square error according to the pixel value of each pixel of the high-definition image;

a noise analysis device, for receiving the high-definition image, and performing a noise analysis of the high-definition image to obtain a primary noise signal with the largest noise amplitude and a secondary noise signal with the second largest noise amplitude, and confirming and using the signal-to-noise ratio of the high-definition image as a target signal-to-noise ratio according to the primary noise signal, the secondary noise signal and the high-definition image will be outputted;

a filter switching device, coupled to the signal analysis device and the noise analysis device, for receiving the target mean square error and the target signal-to-noise ratio, and if the target signal-to-noise ratio is smaller than or equal to a predetermined signal-to-noise ratio threshold and the target mean square error is greater than or equal to predetermined mean square error threshold, then a first switch signal will be outputted, and if the target signal-to-noise ratio is smaller than or equal to the predetermined signal-to-noise ratio threshold and the target mean square error is greater than the predetermined mean square error threshold, then a second switch signal will be outputted, and if the target signal-to-noise ratio is greater than the predetermined signal-to-noise ratio threshold and the target mean square error is greater than or equal to the predetermined mean square error threshold, then a third switch signal will be outputted, and if the target signal-to-noise ratio is greater than the predetermined signal-to-noise ratio threshold and the target mean square error is smaller than the predetermined mean square error threshold, then a fourth switch signal;

a Kalman filter device, coupled to the filter switching device, for performing a Kalman filtering of the high-definition image to obtain a target filtered image, after receiving the fourth switch signal; the self-adjusting wavelet filter device is coupled to the filter switching device for performing a self-adjusting wavelet filtering of the high-definition image to obtain the wavelet filtered image and transmitting the wavelet filtered image to the self-adjusting median filtering device, when receiving the first switch signal; as well as performing a self-adjusting wavelet filtering of the high-definition image to obtain the target filtered image directly when receiving the third switch signal;

a self-adjusting median filtering device, coupled to the filter switching device, for receiving the wavelet filtered image from the self-adjusting wavelet filter device when receiving the first switch signal, and preforming a self-adjusting median filtering of the wavelet filtered image to obtain a target filtered image; and performing a self-adjusting median filtering of the high-definition image to directly obtain the target filtered image when receiving the second switch signal;

a target recognition device, coupled to the Kalman filter device, the self-adjusting wavelet filter device and the self-adjusting median filtering device, for receiving the target filtered image, and matching the target filtered image with various benchmark dangerous conduct appearances or profiles one by one, and outputting a dangerous conduct signal if there is a match, or outputting a non-dangerous conduct signal if there is no match at all;

a power conversion device, coupled to the voltage conversion device, for confirming the collaborative playback power of the U-shaped iron, magnet, washer, voice coil, voice coil paper tube, damper, box holder, gasket, low-frequency suspension edge, high-frequency anti-dust cap and mid-frequency vibrating plate; and an embedded processing device, coupled to the target recognition device, for transmitting a power increasing signal to the power conversion device when receiving the dangerous conduct signal, or transmitting a power decreasing signal to the power conversion device when receiving the non-dangerous conduct signal;

wherein, the self-adjusting median filtering carried out by the self-adjusting median filtering device comprises: obtaining different types of blocks for each pixel of the received image by using different filtering windows for the pixels and the pixel as the center, confirming the grey variance of the blocks of each type, selecting the filtering window corresponding to the smallest grey variance as a target filtering window, performing a median filtering of the pixel value of the pixel to obtain a filtered pixel value, obtaining the filtered image outputted from the self-adjusting median filtering device according to the filtered pixel values of all pixels of the image; wherein the self-adjusting wavelet filtering performed by the self-adjusting wavelet filter device comprises: performing a wavelet decomposition of the received image to obtain four sub-bands LL, LH, HL, HH, confirming the mean of the four sub-bands, calculating an optical threshold of a wavelet contraction based on the mean, performing a wavelet reconstruction of the image based on the optimal threshold of the wavelet contraction to obtain the filtered image outputted by the self-adjusting wavelet filter device;

Wherein, the self-adjusting wavelet filtering performed by the self-adjusting wavelet filter device comprises: performing a wavelet decomposition of the received image to obtain four sub-bands LL, LH, HL, HH, confirming the mean of the four sub-bands, calculating an optical threshold of a wavelet contraction based on the mean, performing a wavelet reconstruction of the image based on the optimal threshold of the wavelet contraction to obtain the filtered image outputted by the self-adjusting wavelet filter device;

Wherein, the Kalman filter device enters from the power saving mode into the operating mode when receiving the fourth switch signal, and the self-adjusting wavelet filter device enters from the power saving mode into the operating mode after receiving the first switch signal or third switch signal, and the self-adjusting median filtering device enters from the power saving mode into the operating mode when receiving the first switch signal or second switch signal.

In the image recognition-based electric speaker, the self-adjusting wavelet filter device enters from an operating mode into a power saving mode when receiving the second switch signal or the fourth switch signal.

In the image recognition-based electric speaker, the self-adjusting median filtering device enters from the operating mode into the power saving mode when receiving the third switch signal or the fourth switch signal.

In the image recognition-based electric speaker, the Kalman filter device enters from the operating mode into the power saving mode when receiving the first switch signal, second switch signal or third switch signal.

DESCRIPTION OF THE PREFERRED EMBODIMENTS

The technical contents of the present invention will become apparent with the detailed description of preferred embodiments accompanied with the illustration of related drawings as follows. It is intended that the embodiments and figures disclosed herein are to be considered illustrative rather than restrictive.

Common speakers include the following types: Paper cone has the features of natural tone, low price, good rigidity, lightweight material, and high sensitivity and the disadvantages of poor moisture resistance and high difficulty of controlling the consistence of the manufacture. However, the paper cone is often used in high-end HiFi systems because of its good sound output and reversibility. Bullet-proof fabric cone has the features of wide frequency response and low distortion, and thus it is the first choice for strong bass lovers, and its disadvantages include high cost, complicated manufacturing process, insufficient sensitivity, and poor effect of light music. Wool knit cone has the features of soft texture, and thus provides excellent performance for soft music and light music and the disadvantages of poor bass effect and lack of strength and shocking power. Polypropylene (PP) cone is popular in high-end speakers and has the features of good consistency, low distortion, and remarkable performance in all aspects. In addition, there are fiber diaphragms and composite diaphragms, and they are expensive and thus are seldom used in common speakers.

However, the present existing police speakers have a single output power control mode which cannot be self-adjusted according to the ambient conditions. To overcome the deficiency of the conventional police speakers, the present invention provides an image recognition-based electric speaker to overcome the aforementioned technical problem of the prior art.

Figure 1:
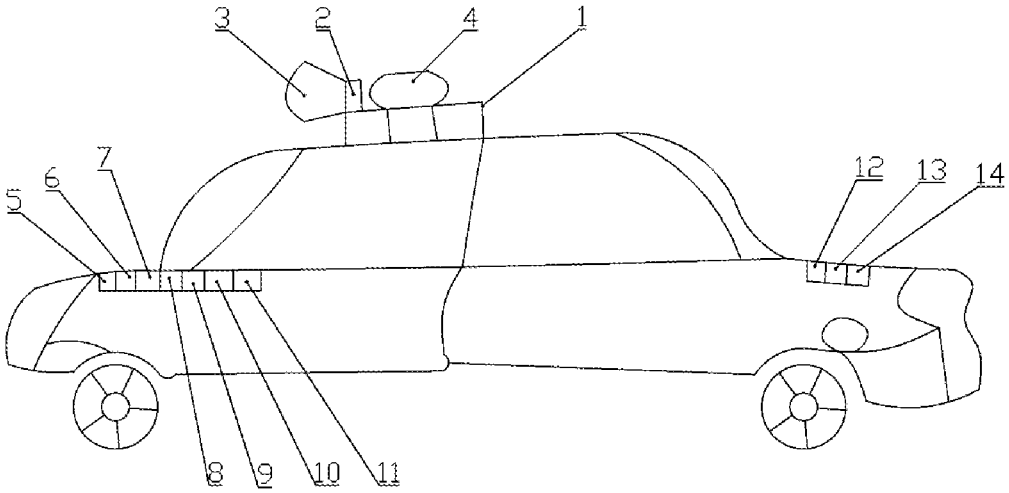
FIG. 1 is a diagram of an image recognition-based electric speaker in accordance with an embodiment of the present invention, mounted on a car. The image recognition-based electric speaker comprises: a brightness sensor 1; an auxiliary lighting source 2; a megaphone 3; a spherical photography device 4; a signal analysis device 5; a noise analysis device 6; a filter switching device 7; a Kalman filter device 8; an embedded processing device 9; a power conversion device 10; a voltage conversion device 11; a self-adjusting wavelet filter device 12; a self-adjusting median filtering device 13; and a target recognition device 14.
Figure 2:
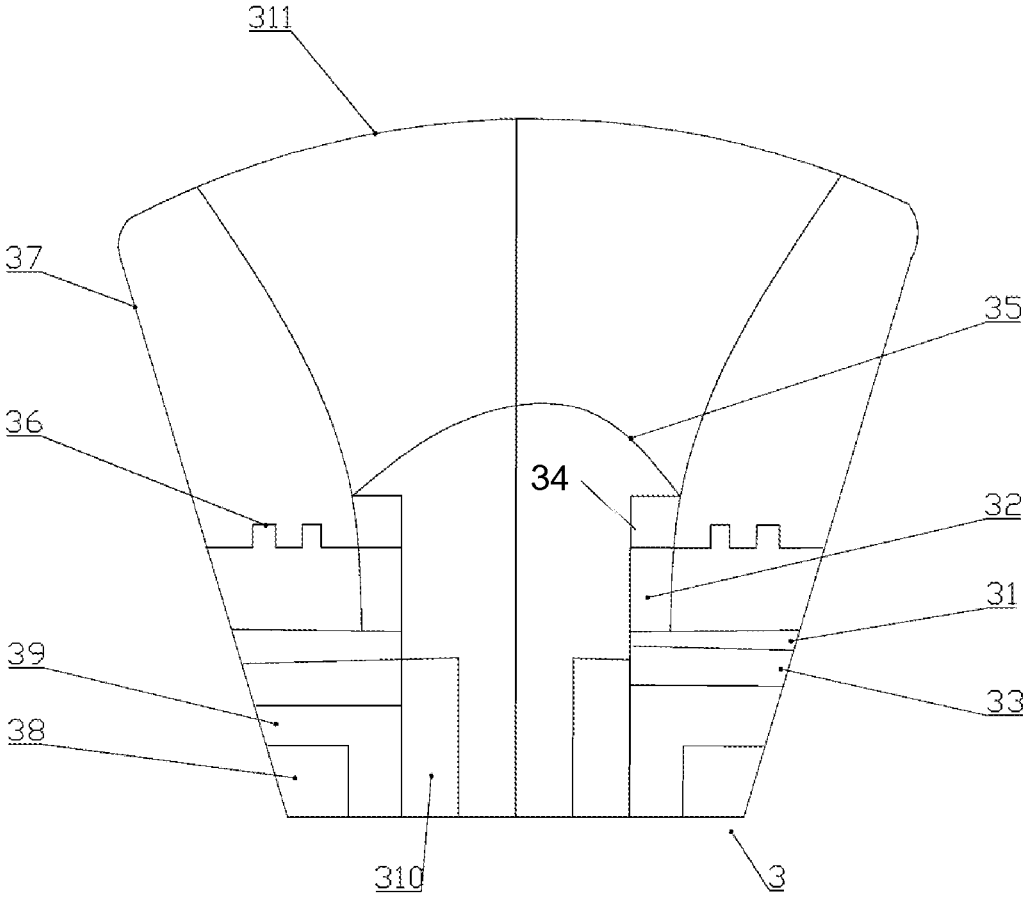
FIG. 2 shows the internal structure of the megaphone 3, illustrating the relative positions of the components of the megaphone 3. The megaphone 3 includes: a U-shaped iron 31; a magnet 32; a washer 33; a voice coil 34; a voice coil paper tube 35; a damper 36; a box holder 37; a gasket 38; a low frequency suspension edge 39; a high frequency anti dust cap 3111; and a mid-frequency vibrating plate 310.

With reference to FIG. 1 for the structural block diagram of an image recognition-based electric speaker in accordance with an embodiment of the present invention, the speaker comprises a U-shaped iron, a magnet, a washer, a voice coil, a voice coil paper tube, a damper, a box holder, a gasket, a low-frequency suspension edge, a high-frequency anti-dust cap and a mid-frequency vibrating plate; wherein the U-shaped iron, magnet, washer, voice coil, voice coil paper tube, damper, box holder, gasket, low-frequency suspension edge, high-frequency anti-dust cap and mid-frequency vibrating plate are combined to form a speaker structure, and the speaker further comprises a manual switch and a manual volume adjuster which are both coupled to the speaker structure.

The U-shaped iron increases the intensity of magnetic field and improves the outer antimagnetic effect, and the magnet is disposed on the U-shaped iron for generating a magnetic field, and the washer is installed on the magnet for increasing the emphasis of magnetic field and magnetic permeability, and the voice coil is disposed on the washer for electrically conduct the power, and the damper is installed around the voice coil for maintaining the magnetic gap and improving the capability of withstanding power.

The voice coil paper tube is installed on the voice coil, and the anti-dust cap is installed on the voice coil paper tube, and the mid-frequency vibrating plate is installed around the anti-dust cap, and the low-frequency suspension edge is disposed around the mid-frequency vibrating plate, and the box holder is installed around the low-frequency suspension edge, and the gasket is installed at a lower edge of the box holder for sealing the box holder airtightly.

The specific structure of the image recognition-based electric speaker of the present invention will be described in further details below.

The speaker further comprises a voltage conversion device coupled to the vehicle power supply for converting an output voltage of the vehicle power supply to obtain different supply voltages required by the electric speaker.

The speaker further comprises a brightness sensor installed at a police car rooftop and near the spherical photography device for detecting the ambient brightness of the spherical photography device.

The speaker further comprises an auxiliary lighting source installed at the police car rooftop and near the spherical photography device and coupled to the brightness sensor for receiving the ambient brightness and providing an auxiliary illuminating light based on the ambient brightness which is an image data collected by the spherical photography device.

The speaker further comprises:

a megaphone, coupled to the embedded processing device in the front-end dashboard of the police car through a cable, for receiving a person's voice in the police car, and amplifying and playing the person's voice through the effect of the U-shaped iron, magnet, washer, voice coil, voice coil paper tube, damper, box holder, gasket, low-frequency suspension edge, high-frequency anti-dust cap and mid-frequency vibrating plate; a spherical photography device, installed on the box holder, for photographing a street view of where the police car is situated, to obtain and output a corresponding high-definition image; a signal analysis device, coupled to the spherical photography device, for receiving a high-definition image, and outputting a mean square error as a target mean square error based on that the pixel value of each pixel of the high-definition image is confirmed to be the pixel value of the high-definition image;

a noise analysis device, for receiving high-definition image, and performing a noise analysis of the high-definition image to obtain a primary noise signal with the largest noise amplitude and a secondary noise signal with the second largest noise amplitude, and outputting a signal-to-noise ratio of the high-definition image as the target signal-to-noise ratio based on that the primary noise signal, the secondary noise signal and the high-definition image are confirmed;

a filter switching device, coupled to the signal analysis device and the noise analysis device, for receiving the target mean square error and the target signal-to-noise ratio, and if the target signal-to-noise ratio is smaller than or equal to predetermined signal-to-noise ratio threshold and the target mean square error is greater than or equal to the predetermined mean square error threshold, then a first switch signal will be outputted; if the target signal-to-noise ratio is smaller than or equal to the predetermined signal-to-noise ratio threshold and the target mean square error is greater than predetermined mean square error threshold, then a second switch signal will be outputted; if the target signal-to-noise ratio is greater than the predetermined signal-to-noise ratio threshold and the target mean square error is greater than or equal to the predetermined mean square error threshold, then a third switch signal will be outputted; and if the target signal-to-noise ratio is greater than the predetermined signal-to-noise ratio threshold and the target mean square error is smaller than the predetermined mean square error threshold, then a fourth switch signal will be outputted;

a Kalman filter device, coupled to the filter switching device, for performing a Kalman filtering of the high-definition image to obtain a target filtered image when receiving the fourth switch signal;

a self-adjusting wavelet filter device, coupled to the filter switching device, for performing a self-adjusting wavelet filtering of the high-definition image to obtain a wavelet filtered image and transmitting the wavelet filtered image to the self-adjusting median filtering device when receiving the first switch signal, and performing a self-adjusting wavelet filtering of the high-definition image to obtain the target filtered image directly when receiving the third switch signal;

a self-adjusting median filtering device, coupled to the filter switching device, for receiving the wavelet filtered image from the self-adjusting wavelet filter device and performing a self-adjusting median filtering of the wavelet filtered image to obtain the target filtered image when receiving the first switch signal; and when receiving the second switch signal performing a self-adjusting median filtering of the high-definition image to obtain a target filtered image directly;

a target recognition device, coupled to the Kalman filter device, the self-adjusting wavelet filter device and the self-adjusting median filtering device, for receiving the target filtered image and matching the target filtered image with various benchmark dangerous conduct appearances or profiles one by one, and if there is a match, then the dangerous conduct signal will be outputted, and if there is no match at all, then a non-dangerous conduct signal will be outputted;

a power conversion device, coupled to the voltage conversion device, for confirming the collaborative playback power of the U-shaped iron, magnet, washer, voice coil, voice coil paper tube, damper, box holder, gasket, low-frequency suspension edge, high-frequency anti-dust cap and mid-frequency vibrating plate;

an embedded processing device, coupled to the target recognition device, for transmitting a power increasing signal to the power conversion device when receiving the dangerous conduct signal and transmitting a power decreasing signal to the power conversion device when receiving the non-dangerous conduct signal;

wherein, the self-adjusting median filtering carried out by the self-adjusting median filtering device comprises: obtaining different types of blocks for each pixel of the received image by using different filtering windows for the pixels and the pixel as the center, confirming the grey variance of the blocks of each type, selecting the filtering window corresponding to the smallest grey variance as a target filtering window, performing a median filtering of the pixel value of the pixel to obtain a filtered pixel value, obtaining the filtered image outputted from the self-adjusting median filtering device according to the filtered pixel values of all pixels of the image; wherein the self-adjusting wavelet filtering performed by the self-adjusting wavelet filter device comprises: performing a wavelet decomposition of the received image to obtain four sub-bands LL, LH, HL, HH, confirming the mean of the four sub-bands, calculating an optical threshold of a wavelet contraction based on the mean, performing a wavelet reconstruction of the image based on the optimal threshold of the wavelet contraction to obtain the filtered image outputted by the self-adjusting wavelet filter device;

wherein the Kalman filter device enters from the power saving mode into the operating mode when receiving the fourth switch signal, and the self-adjusting wavelet filter device enters from the power saving mode into the operating mode after receiving the first switch signal or third switch signal, and the self-adjusting median filtering device enters from the power saving mode into the operating mode when receiving the first switch signal or second switch signal.

In the speaker, the self-adjusting wavelet filter device enters from an operating mode into a power saving mode when receiving the second switch signal or the fourth switch signal.

In the speaker, the self-adjusting median filtering device enters from the operating mode into the power saving mode when receiving the third switch signal or the fourth switch signal.

In the speaker, the Kalman filter device enters from the operating mode into the power saving mode when receiving the first switch signal, second switch signal or third switch signal.

In addition, the image filtering suppresses the noise as shown in the target icon in the figure while maintaining the detailed characteristics of the image as much as possible, and this is a necessary operation in an image pre-processing process, and the effect of the processing directly affects the validity and reliability of the subsequent image processing and analysis.

Due to the imperfections in imaging systems, transmission media and recording devices, the formation and transmitting process of digital images are often affected by various types of noises. In addition, noises may be introduced into the resulted image in some imaging processing cases, if the inputted image object is not as expected. These noises are often expressed in form of an isolated pixel or block of an image having a strong visual effect. In general, a noise signal appears as useless information with respect to a studied object but it will disturb the observable information of the image. Digital image signals and noises are in the maximum or minimum values, and these extremum values may cause bright or dark spots of an image and lower the image quality significantly through the addition or subtraction of these extremum values on the real grey value of the image pixel, or even affects the restoration, division, characteristic fetching, image identification of the image. It is necessary to take the following two basic factors into consideration on the effect of suppressing noises effectively: The noises in the target and background must be removed effectively. In addition, the target shape, size, and specific geometrically and topologically structural characteristics of the image must be protected properly.

One of the common image filtering modes is a nonlinear filter, generally. If a signal spectrum is mixed and overlapped with a noise spectrum or a signal contains a non-superimposing noise, such as the existence of a noise caused by system linearity or a non-Gaussian noise, the traditional linear filtering technology such as Fourier transform will express the image in certain fuzzy image details (such as an edge) while filtering the noise. As a result, the positioning precision and extractability of the linear characteristic of the image will be reduced. The nonlinear filter is a nonlinear mapping of the input signal and often maps a certain specific noise to zero while maintaining the desired characteristics of the signal, and thus it can overcome the deficiencies of the linear filter to a certain extent.

Compared with the traditional speakers with a fixed output power, the image recognition-based electric speaker of the present invention integrates a plurality of high-precision image processing devices into the traditional speakers to confirm whether or not any nearby dangerous conduct exists and to perform a self-adjustment of the output power of the speaker, so as to enhance the automation level of the speaker.

While the present invention has been described by means of specific embodiments, numerous modifications and variations could be made thereto by those skilled in the art without departing from the scope and spirit of the present invention set forth in the claims.

What is claimed is:

1. An image recognition-based electric speaker, comprising a U-shaped iron, a magnet, a washer, a voice coil, voice coil paper tube, a damper, a box holder, a gasket, a low-frequency suspension edge, a high-frequency dust resisting cover and a mid-frequency vibrating plate, characterized in that the U-shaped iron increases the intensity of magnetic field and improves the outer antimagnetic effect, and the magnet is disposed on the U-shaped iron for generating a magnetic field, and the washer is installed on the magnet for increasing the emphasis of magnetic field and magnetic permeability, and the voice coil is disposed on the washer for electrically conduct the power, and the damper is installed around the voice coil for maintaining the magnetic gap and improving the capability of withstanding power, and the voice coil paper tube is installed on the voice coil, and the anti-dust cap is installed on the voice coil paper tube, and the mid-frequency vibrating plate is installed around the anti-dust cap, and the low-frequency suspension edge is disposed around the mid-frequency vibrating plate, and the box holder is installed around the low-frequency suspension edge, and the gasket is installed at a lower edge of the box holder for sealing the box holder air tightly;

a voltage conversion device coupled to the vehicle power supply for converting an output voltage of the vehicle power supply to obtain different supply voltages required by the electric speaker;

a brightness sensor installed at a police car rooftop and near the spherical photography device for detecting the ambient brightness of the spherical photography device;

an auxiliary lighting source installed at the police car rooftop and near the spherical photography device and coupled to the brightness sensor for receiving the ambient brightness and providing an auxiliary illuminating light based on the ambient brightness which is an image data collected by the spherical photography device;

a megaphone, coupled to the embedded processing device in the front-end dashboard of the police car through a cable, for receiving a person's voice in the police car, and amplifying and playing the person's voice through the effect of the U-shaped iron, magnet, washer, voice coil, voice coil paper tube, damper, box holder, gasket, low-frequency suspension edge, high-frequency dust resisting cover and mid-frequency vibrating plate;

a spherical photography device, installed on the box holder, for photographing a street view of where the police car is situated, to obtain and output a corresponding high-definition image;

a signal analysis device, coupled to the spherical photography device, for receiving a high-definition image, and outputting a mean square error as a target mean square error based on that the pixel value of each pixel of the high-definition image is confirmed to be the pixel value of the high-definition image;

a noise analysis device, for receiving high-definition image, and performing a noise analysis of the high-definition image to obtain a primary noise signal with the largest noise amplitude and a secondary noise signal with the second largest noise amplitude, and outputting a signal-to-noise ratio of the high-definition image as the target signal-to-noise ratio based on that the primary noise signal, the secondary noise signal and the high-definition image are confirmed;

a filter switching device, coupled to the signal analysis device and the noise analysis device, for receiving the target mean square error and the target signal-to-noise ratio, and if the target signal-to-noise ratio is smaller than or equal to predetermined signal-to-noise ratio threshold and the target mean square error is greater than or equal to the predetermined mean square error threshold, then a first switch signal will be outputted; if the target signal-to-noise ratio is smaller than or equal to the predetermined signal-to-noise ratio threshold and the target mean square error is greater than predetermined mean square error threshold, then a second switch signal will be outputted; if the target signal-to-noise ratio is greater than the predetermined signal-to-noise ratio threshold and the target mean square error is greater than or equal to the predetermined mean square error threshold, then a third switch signal will be outputted; and if the target signal-to-noise ratio is greater than the predetermined signal-to-noise ratio threshold and the target mean square error is smaller than the predetermined mean square error threshold, then a fourth switch signal will be outputted;

a Kalman filter device, coupled to the filter switching device, for performing a Kalman filtering of the high-definition image to obtain a target filtered image when receiving the fourth switch signal;

a self-adjusting wavelet filter device, coupled to the filter switching device, for performing a self-adjusting wavelet filtering of the high-definition image to obtain a wavelet filtered image and transmitting the wavelet filtered image to the self-adjusting median filtering device when receiving the first switch signal, and performing a self-adjusting wavelet filtering of the high-definition image to obtain the target filtered image directly when receiving the third switch signal;

a self-adjusting median filtering device, coupled to the filter switching device, for receiving the wavelet filtered image from the self-adjusting wavelet filter device and performing a self-adjusting median filtering of the wavelet filtered image to obtain the target filtered image when receiving the first switch signal; and when receiving the second switch signal performing a self-adjusting median filtering of the high-definition image to obtain a target filtered image directly;

a target recognition device, coupled to the Kalman filter device, the self-adjusting wavelet filter device and the self-adjusting median filtering device, for receiving the target filtered image and matching the target filtered image with various benchmark dangerous conduct appearances or profiles one by one, and if there is a match, then the dangerous conduct signal will be outputted, and if there is no match at all, then a non-dangerous conduct signal will be outputted;

a power conversion device, coupled to the voltage conversion device, for confirming the collaborative playback power of the U-shaped iron, magnet, washer, voice coil, voice coil paper tube, damper, box holder, gasket, low-frequency suspension edge, high-frequency dust resisting cover and mid-frequency vibrating plate;

an embedded processing device, coupled to the target recognition device, for transmitting a power increasing signal to the power conversion device when receiving the dangerous conduct signal and transmitting a power decreasing signal to the power conversion device when receiving the non-dangerous conduct signal;

wherein, the self-adjusting median filtering carried out by the self-adjusting median filtering device comprises:

obtaining different types of blocks for each pixel of the received image by using different filtering windows for the pixels and the pixel as the center, confirming the grey variance of the blocks of each type, selecting the filtering window corresponding to the smallest grey variance as a target filtering window, performing a median filtering of the pixel value of the pixel to obtain a filtered pixel value, obtaining the filtered image outputted from the self-adjusting median filtering device according to the filtered pixel values of all pixels of the image; wherein the self-adjusting wavelet filtering performed by the self-adjusting wavelet filter device comprises: performing a wavelet decomposition of the received image to obtain four sub-bands LL, LH, HL, HH, confirming the mean of the four sub-bands, calculating an optical threshold of a wavelet contraction based on the mean, performing a wavelet reconstruction of the image based on the optimal threshold of the wavelet contraction to obtain the filtered image outputted by the self-adjusting wavelet filter device;

wherein the Kalman filter device enters from the power saving mode into the operating mode when receiving the fourth switch signal, and the self-adjusting wavelet filter device enters from the power saving mode into the operating mode after receiving the first switch signal or third switch signal, and the self-adjusting median filtering device enters from the power saving mode into the operating mode when receiving the first switch signal or second switch signal.

2. The image recognition-based electric speaker according to claim 1, wherein the self-adjusting wavelet filter device enters from an operating mode into a power saving mode when receiving the second switch signal or the fourth switch signal.

3. The image recognition-based electric speaker according to claim 2, wherein the self-adjusting median filtering device enters from the operating mode into the power saving mode when receiving the third switch signal or the fourth switch signal.

4. The image recognition-based electric speaker according to claim 3, wherein the Kalman filter device enters from the operating mode into the power saving mode when receiving the first switch signal, second switch signal or third switch signal.

* * * * *